US005634702A

United States Patent [19]

Fistonich

[11] Patent Number: 5,634,702

[45] Date of Patent: Jun. 3, 1997

[54] HANDS FREE WASTE CONTAINER HAVING A CLOSED COVER THAT AUTOMATICALLY OPENS WHEN THE CONTAINER IS MOVED OUTSIDE ITS CABINET ENCLOSURE

[76] Inventor: Juraj Fistonich, 832 W. 20th St., San Pedro, Calif. 90731

[21] Appl. No.: 534,838

[22] Filed: Sep. 27, 1995

[51] Int. Cl.[6] ..... A47B 96/00

[52] U.S. Cl. ..... 312/270.3; 312/319.4; 312/273

[58] Field of Search ..... 312/273, 274, 312/275, 270.3, 319.4, 319.9

[56] References Cited

U.S. PATENT DOCUMENTS

| | | | |
|---|---|---|---|
| 299,687 | 6/1884 | Seller | 312/319.4 |
| 2,233,796 | 3/1941 | Pines | 312/273 |
| 2,934,390 | 4/1960 | Wright | 312/270.3 |
| 5,215,363 | 6/1993 | Warwick | 312/274 |

*Primary Examiner*—Peter M. Cuomo
*Assistant Examiner*—Gerald A. Anderson
*Attorney, Agent, or Firm*—Irving Keschner

[57] ABSTRACT

A kitchen trash container system wherein a trash container is covered when it is within a kitchen sink cabinet enclosure and wherein the cover automatically opens when the trash container is caused to move outwardly from the cabinet. A latch type member is positioned at the lower portion of the housing, activation of the latch member by a user causing the trash container to move outwardly from the cabinet along a rail member, the cover portion opening during movement of the trash container. When the trash container reaches its outward extent, the cover is in the full open position and enables trash to be deposited in the container. Thereafter, the user pushes the trash container preferably with a knee back into position within the cabinet, the cover automatically closing on top of the trash container.

4 Claims, 5 Drawing Sheets

HANDS FREE WASTE CONTAINER HAVING A CLOSED COVER THAT AUTOMATICALLY OPENS WHEN THE CONTAINER IS MOVED OUTSIDE ITS CABINET ENCLOSURE

BACKGROUND OF THE INVENTION

1. Field of the invention

The present invention provides a waste collection system wherein a covered waste container is stored in a movable draw-like member positioned within a kitchen sink cabinet and which moves outside of the cabinet upon activation of a switch member by a user, the cover automatically opening as the member moves outside the cabinet.

2. Description of the Prior Art

A typical kitchen sink cabinet incorporates a waste receptacle under the sink. The waste receptacle includes an area in which a waste container is positioned to receive and store accumulated waste. The receptacle is usually mounted on a sliding mechanism such that the user can withdraw the receptacle hands free from the cabinet and place waste in the container. The receptacle can be withdrawn automatically by a user depressing a foot pedal, the pedal in turn controlling a latch member. The trash container is typically not covered, the smells and contamination associated with an open trash container being obvious.

What is thus desired is to provide a kitchen trash container system wherein the trash container is covered when it is within the kitchen sink cabinet and automatically opens when the container is caused to move outward from the cabinet.

SUMMARY OF THE INVENTION

The present invention provides a kitchen trash container system wherein a trash container is covered when it is positioned within a kitchen sink cabinet and wherein the cover automatically opens when the container moves outwardly from the cabinet. In particular, a trash container is positioned within the cabinet to receive trash. The container is mounted on a roller type mechanism allowing it to move outwardly from the cabinet. A foot pedal is positioned at the lower portion of the cabinet, activation of the foot pedal by a user causing the mechanism to move outwardly from the cabinet along the rail member, the cover portion starting to open. When the mechanism reaches its outward extent, the cover is in the full open position, enabling the user to deposit trash in the container. Thereafter, the user slides the mechanism back into position within the cabinet, the cover automatically closing on top of the container.

The present invention thus provides a trash container system which allows the covered trash container to automatically withdraw from the kitchen sink cabinet, the cover automatically lifting to allow a user to deposit trash therein without manually having to lift open the cover. When the user pushes the mechanism back into the cabinet preferably with a knee, the cover automatically closes.

The trash is thus fully enclosed when it is within the cabinet minimizing the odorous environment normally associated with trash storage and also minimizing the risk of contamination.

BRIEF DESCRIPTION OF THE DRAWING

For better understanding of the present invention as well as other objects and further features thereof, reference is made to the following description which is to be read in conjunction with the accompanying drawing therein.

DESCRIPTION OF THE INVENTION

Figure 1:
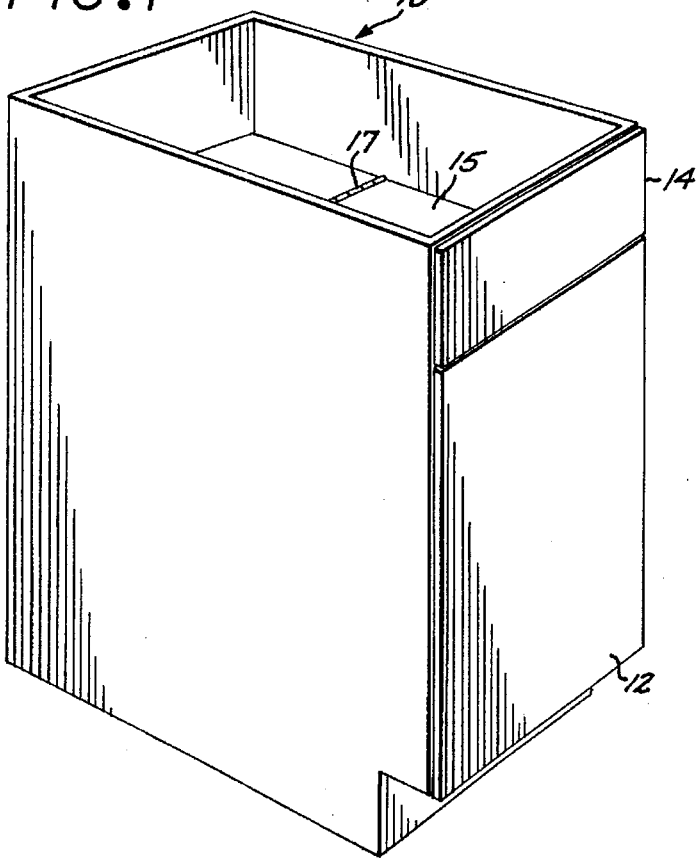
FIG. 1 is a perspective view of a kitchen cabinet incorporating the trash container system of the present invention.
Figure 2:
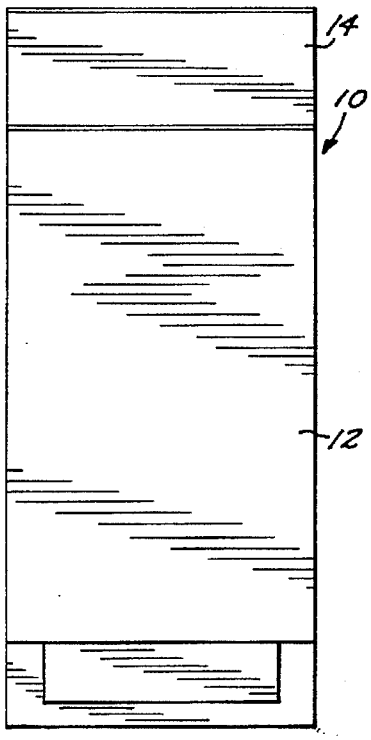
FIG. 2 is a front elevation view of the apparatus shown in FIG. 1.
Figure 8:
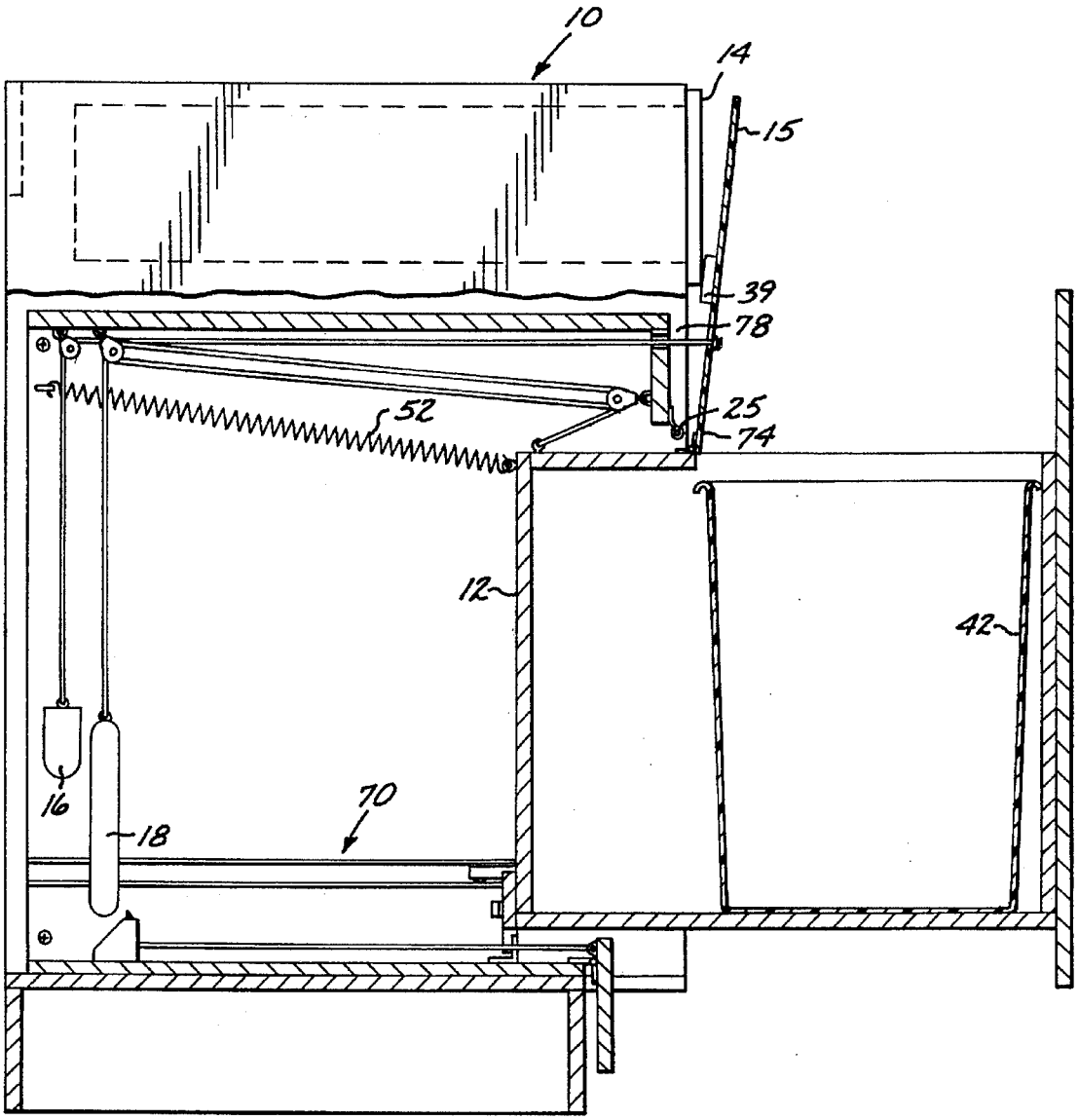
FIG. 8 is a side, cross-sectional elevational view of the cabinet shown in FIG. 1 with the trash containing mechanism extended outwardly from the cabinet with the trash container cover open.

Referring to FIGS. 1 and 2, a kitchen sink 10 adapted to be positioned under and adjacent a kitchen sink is illustrated. Cabinet 10 includes a movable trash drawer, or mechanism, 12 positioned flush with portion 14 of cabinet 10, as shown, or moved outwardly to a full open position as shown in FIG. 8. Also shown is trash container cover 15 pivotable about hinge member 17.

Figure 3:
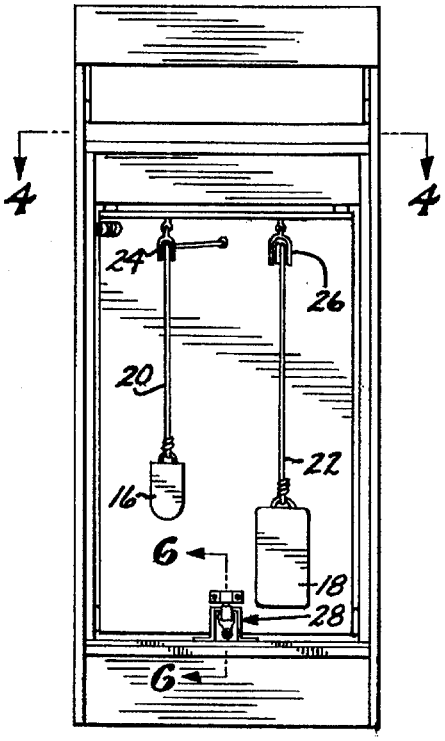
FIG. 3 is similar to FIG. 2 with the cabinet drawer for the trash removed.
Figure 4:
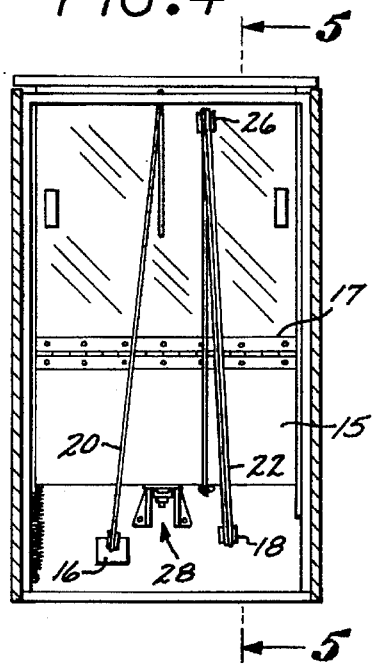
FIG. 4 is a cross-sectional view along line 4—4 of FIG. 3.

FIG. 3 illustrates the interior of cabinet 10 with drawer 12 removed. Mounted within the interior of cabinet 10 are weights 16 and 18 attached to guide ropes 20 and 22, respectively at one end. The other end of rope 20 is positioned about a double pulley 24; the other end of rope 22 is positioned about a double pulley 26 as illustrated. A latch member 28 is provided to enable the drawer 12 to be moved outwardly to the position shown in FIG. 8 when a user depresses, typically with a foot, pedal member 29 (see FIG. 6). FIG. 4 illustrates the interaction of pulley ropes 20 and 22, with the movement of drawer 12 and cover 15.

Figure 5:
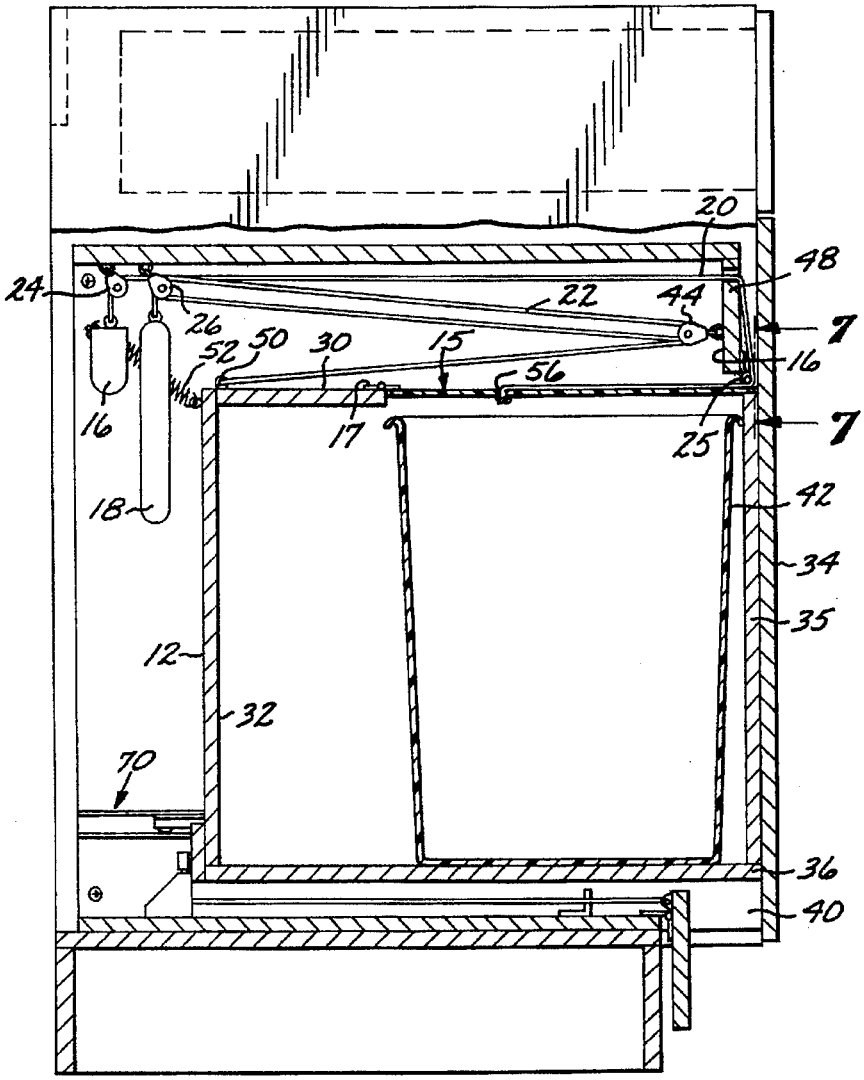
FIG. 5 is a cross-sectional view along line 5—5 of FIG. 4.

FIG. 5 shows in detail trash drawer 12, drawer 12 comprising upper portion 30, side portions 32 and 34 and bottom portion 36. Cover member 15, pivotable about hinge member 17, covers the opening formed between top portion 30 and side portion 34. Bottom portion 36 of drawer 12 is supported on lower platform 40. A trash container 42 is positioned within drawer 12 below cover 15 as illustrated. Pulley ropes 22 extends about pulley 44, pulley 44 being attached to the inside surface 46 of cabinet portion 48. The other end of rope 22 terminates at point 50 located on the top of drawer 12 as illustrated. A compression spring 52 has one end attached to drawer 12, the other end being connected to the drawer 12 as illustrated in FIG. 8. The other end of rope 20 extends through an opening formed in cabinet portion 48 and is attached to cover 15 at point 56.

Figure 6:
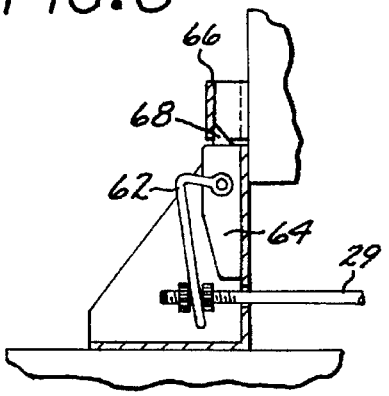
FIG. 6 is a cross-sectional view along line 6—6 of FIG. 3.

FIG. 6 provides more detail of the mechanism used to release the trash module 12 from the cabinet 10. In particular, foot pedal 29 is connected by link member 62 to receptacle 64. A member 66 is attached to drawer 12 and has a tongue portion 68 inserted into an aperture formed in receptacle member 64 when drawer 12 is in the closed position. When it is desired to withdraw drawer 12 from cabinet 10, a user presses down on pedal lever 60, causing member 64 to be rotated whereby tongue portion 68 exits from receptacle 64 enabling weight 16 to force drawer 12 to the outward position shown in FIG. 8, spring 52 controlling the movement of drawer 12 along the rail system 70 shown in FIGS. 5 and 8.

Figure 7:
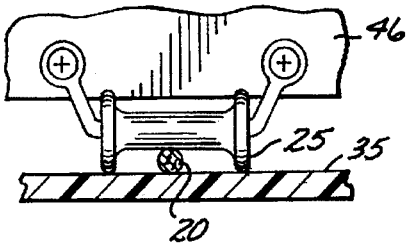
FIG. 7 is a view along line 7—7 of FIG. 5.

Referring to FIG. 7, pulley 25 is mounted to housing portion 46, rope 20 passing under pulley 25 as illustrated. Rope 20, as noted hereinabove, opens or closes cover 15.

FIG. 8 illustrates the situation wherein the drawer 12 is in the fully open position, allowing trash container 42 to receive trash since cover member 15 is in the open position, stop member 39 on cover 15 abutting against the upper portion of the cabinet. Drawer 12 is slidable along rail system 70 in a conventional manner. Weight 18 is shown in its lowest position, the movement of weight 18 downwardly by the force of gravity forcing drawer 12 to the open position.

In operation, and assuming the trash drawer 12 is in the fully closed position as shown in FIG. 5, a user desiring to dispose of trash steps on pedal 29, releasing the trash drawer 12 from engagement with the surrounding cabinet. Weight 16 than acts to force trash drawer 12, guided by a conventional drawer rail system 70, towards the fully open position. During this period, weights 16 and 18 move downwardly to the lowest positions shown in FIG. 8, weight 16, via rope 20, raising the cover member 15 as illustrated. When the user finishes depositing trash in container 42, drawer member 12 is moved towards cabinet portion 14, cover member 15 being positioned above the opening of container 42 as the lower portion 74 thereof is wedged against the lower portion 76 of plate member 78. Weight 16 and rope 20 function, in essence, to control the rate of movement of the cover member 15 as it moves between open and closed positions.

Figure 9:
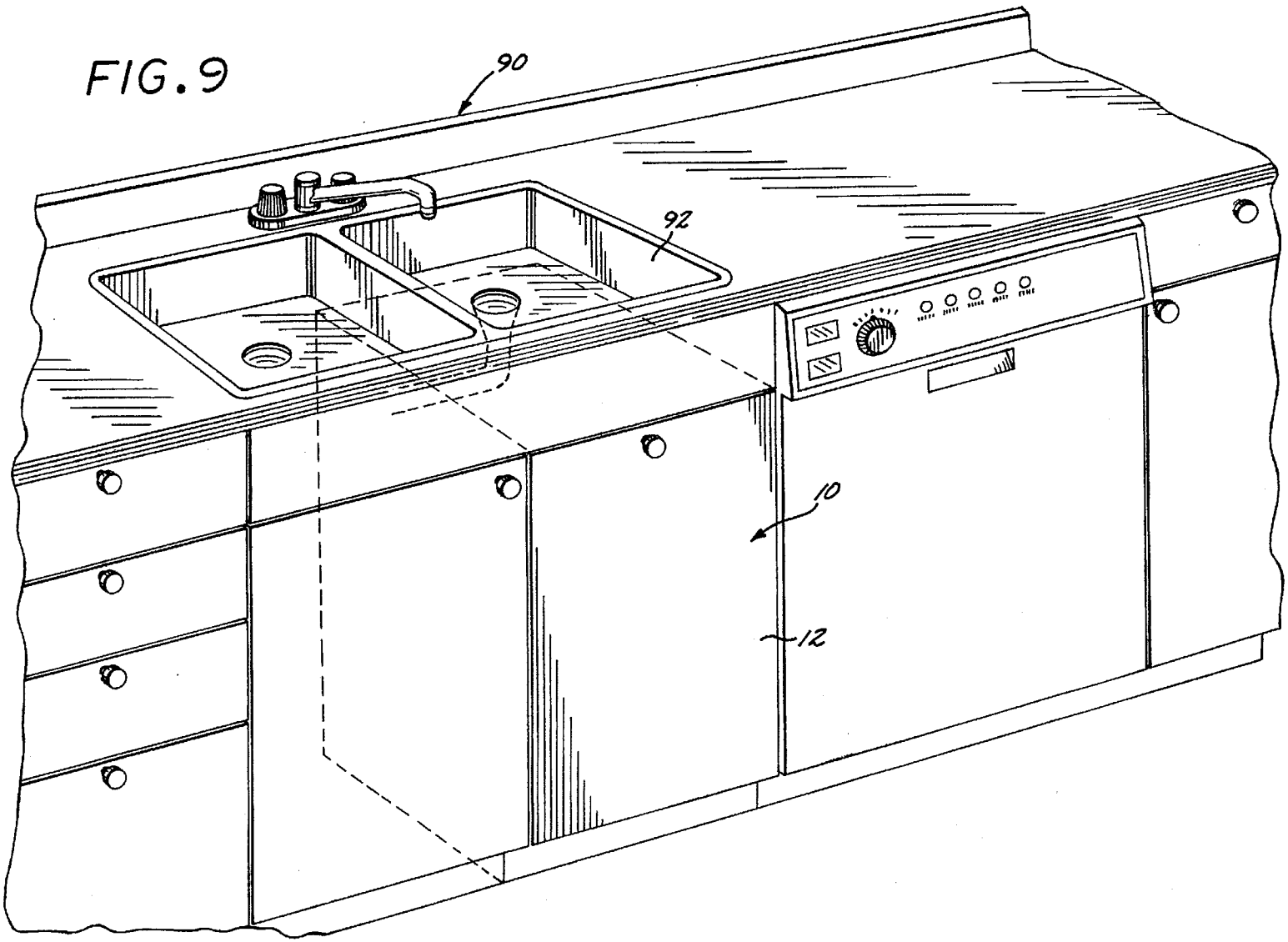
FIG. 9 is a partial perspective view showing the cabinet of the present invention under a kitchen sink in a closed position.

FIG. 9 is a perspective view illustrating module 10 positioned under the right handed sink portion 92 of conventional kitchen sink module 90 as illustrated. Drawer 12 is shown in the closed position.

Figure 10:
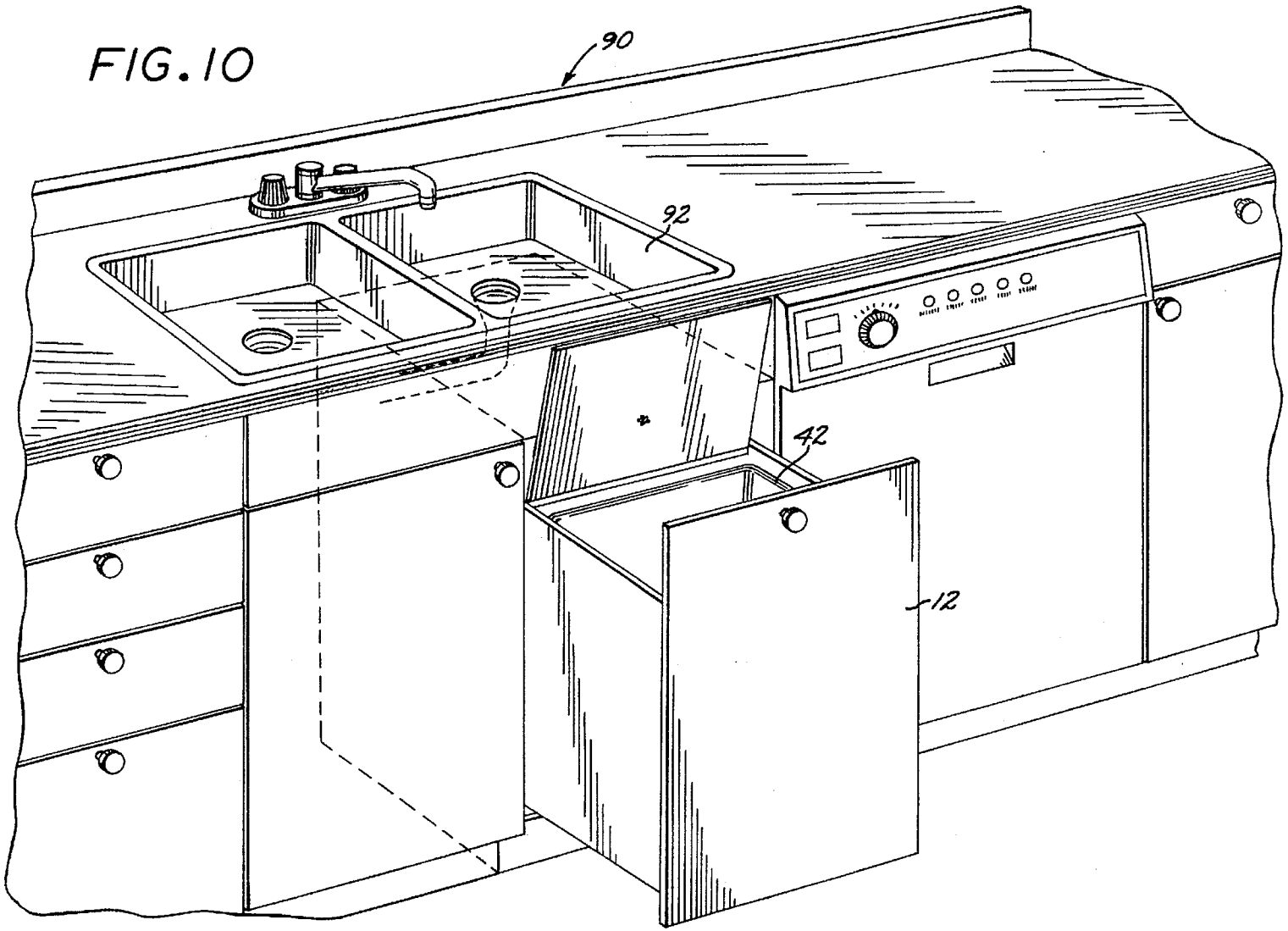
FIG. 10 is a partial perspective view showing the cabinet of the present invention under a kitchen sink in the open position.

FIG. 10 is similar to FIG. 9 with drawer 12 in the open, or extended, position.

The present invention thus provides an improved kitchen trash containment system which enables a person to have easy access to a trash receptacle wherein the receptacle is covered within its cabinet enclosure to reduce odors and contamination and wherein the cover automatically opens when the receptacle is positioned to receive trash.

While the invention has been described with reference to its preferred embodiments, it will be understood by those skilled in the art that various changes may be made and equivalents may be substituted for elements thereof without departing from the true spirit and scope of the invention. In addition, many modifications may be made to adapt a particular situation or material to the teachings of the invention without departing from its essential teachings.

What is claimed is:

1. A hands free waste container having a cover that automatically uncovers the container when the container is moved outside a cabinet enclosure comprising:

a waste container positioned within a cabinet enclosure having a cover movable between open and closed positions;

a waste receptacle positioned within said waste container and below said cover;

means for forcing said waste container away from said cabinet enclosure upon activation of a member by the waste container user, said forcing means comprising a weight coupled to said waste container by a pulley and an elongated member; and means for maintaining said cover closed when said waste container is within said cabinet enclosure and moving said cover to an open position as said waste container is forced away from cabinet enclosure.

2. The waste container of claim 1 wherein said waste container is positioned below a kitchen sink.

3. A hands free waste container having a cover that automatically uncovers the container when the container is moved outside a cabinet enclosure comprising:

a waste container positioned within a cabinet enclosure having a cover movable between open and closed positions;

a waste receptacle positioned within said waste container and below said cover;

means for forcing said waste container away from said cabinet enclosure upon activation of a member by the waste container user; and means for maintaining said cover closed when said waste container is within said cabinet enclosure and moving said cover to an open position as said waste container is forced away from cabinet enclosure, said maintaining means comprising a weight coupled to said cover by a pulley and an elongated member.

4. The waste container of claim 3 wherein said waste container is positioned below a kitchen sink.

* * * * *